US010590636B2

(12) United States Patent
Schoenbeck et al.

(10) Patent No.: US 10,590,636 B2
(45) Date of Patent: Mar. 17, 2020

(54) HYBRID FITTING WITH WATER JET DETECTION

(71) Applicant: Grohe AG, Hemer (DE)

(72) Inventors: Heiko Schoenbeck, Hemer (DE); Andreas Jung, Froendenberg (DE); Stefan Steinhoff, Sundern (DE)

(73) Assignee: Grohe AG, Hemer (DE)

( * ) Notice: Subject to any disclaimer, the term of this patent is extended or adjusted under 35 U.S.C. 154(b) by 267 days.

(21) Appl. No.: 15/696,627

(22) Filed: Sep. 6, 2017

(65) Prior Publication Data

US 2017/0368565 A1 Dec. 28, 2017

Related U.S. Application Data

(63) Continuation of application No. PCT/EP2016/000379, filed on Mar. 4, 2016.

(30) Foreign Application Priority Data

Mar. 6, 2015 (DE) ..... 10 2015 002 779

(51) Int. Cl.
*E03C 1/05* (2006.01)

(52) U.S. Cl.
CPC ..... *E03C 1/057* (2013.01); *E03C 1/055* (2013.01)

(58) Field of Classification Search
CPC ..... E03C 1/055; E03C 1/057
See application file for complete search history.

(56) References Cited

U.S. PATENT DOCUMENTS

| | | | | |
|---|---|---|---|---|
| 4,767,922 | A | 8/1988 | Stauffer | |
| 5,566,702 | A | 10/1996 | Phillipp | |
| 5,819,336 | A * | 10/1998 | Gilliam | E03C 1/057 4/623 |
| 6,003,170 | A | 12/1999 | Humpert et al. | |
| 7,472,433 | B2 * | 1/2009 | Rodenbeck | E03C 1/057 137/607 |
| 8,612,057 | B2 * | 12/2013 | Murata | E03C 1/057 251/129.04 |

(Continued)

FOREIGN PATENT DOCUMENTS

| | | |
|---|---|---|
| DE | 2034 877 B1 | 12/1971 |
| EP | 088 2848 A2 | 12/1998 |

(Continued)

OTHER PUBLICATIONS

International Search Report dated Jun. 10, 2016 (English Translation).

*Primary Examiner* — Erin Deery
(74) *Attorney, Agent, or Firm* — Muncy, Geissler, Olds & Lowe, P.C.

(57) ABSTRACT

A method for operating a sanitary fitting, and to a sanitary fitting. The sanitary fitting is equipped to deliver a water jet and has at least one manual actuator for manual regulation of at least one water jet flow rate or a water jet temperature, and a sensor arrangement that is equipped for sensor-controlled regulation of a predefined water jet flow rate and a predefined water jet temperature. The sensor arrangement is equipped to detect the presence of an object in an external detection area and a control unit is provided to distinguish whether the object detected first is a water jet or a different object.

9 Claims, 3 Drawing Sheets

(56) References Cited

U.S. PATENT DOCUMENTS

| | | | | |
|---|---|---|---|---|
| 9,010,377 | B1 * | 4/2015 | O'Brien | E03C 1/057 137/801 |
| 2007/0156260 | A1 | 7/2007 | Rodenbeck et al. | |
| 2011/0000559 | A1 | 1/2011 | Murata et al. | |
| 2013/0248019 | A1 | 9/2013 | Frick et al. | |

FOREIGN PATENT DOCUMENTS

| | | | |
|---|---|---|---|
| EP | 2233 650 | A1 | 9/2010 |
| EP | 269 0328 | A1 | 1/2014 |
| JP | 2006 283 441 | A | 10/2006 |
| WO | WO 9894 1701 | A1 | 9/1998 |
| WO | WO 2013 134 525 | A2 | 9/2013 |

* cited by examiner

HYBRID FITTING WITH WATER JET DETECTION

This nonprovisional application is a continuation of International Application No. PCT/EP2016/000379, which was filed on Mar. 4, 2016, and which claims priority to German Patent Application No. 10 2015 002 779.4, which was filed in Germany on Mar. 6, 2015, and which are both herein incorporated by reference.

BACKGROUND OF THE INVENTION

Field of the Invention

The present invention relates to a method for operating a sanitary fitting, and to a sanitary fitting having at least one manual actuator and a sensor arrangement. The sanitary fitting serves, in particular, to regulate a water jet flow rate and/or a water jet temperature.

Description of the Background Art

Sanitary fittings are, in particular, thermostatic mixing fittings that are designed as washbasin fittings, shower fittings, or bathtub fittings. To this end, the sanitary fittings frequently have a hot water inlet for hot water and a cold water inlet for cold water. In this case, the hot water and the cold water are mixed into mixed water in the sanitary fitting by means of a regulator at a predefinable mixing ratio.

So-called hybrid fittings are also known, and these are formed of, e.g., a single-lever mixer and an infrared fitting. The two types of fitting can be used independently from one another. In this design, the mixed water flow rate and/or the mixed water temperature are regulated mechanically by means of the single-lever mixer as a function of the lever position. Independently therefrom, a preset water flow rate and a preset water temperature can be triggered in a touchless manner by means of the infrared fitting.

In order to be able to make meaningful use of this type of combination of a single-lever mixer and an infrared fitting, the infrared fitting must obtain information as to whether a mechanical or manual regulation has been carried out by means of the adjusting lever. It is known for this purpose to mechanically detect the lever position of the adjusting lever by means of additional measuring elements. An additional measuring element of this type can be implemented in the manner of, e.g., a switch, a position sensor, an angle sensor, or a strain gauge. This measuring element interacts directly with the adjusting lever.

Because of the additional measuring elements, prior art hybrid fittings are generally expensive, and it is not possible to use standard components, in particular standard single-lever mixers, adjusting levers, and/or standard valves. Moreover, the additional mechanical measuring elements contribute to increased wear of the prior art hybrid fittings.

SUMMARY OF THE INVENTION

It is therefore an object of the present invention to at least partially solve the problems described with reference to the prior art. In particular, a sanitary fitting is to be specified that is economical to produce, allows a use of standard components, and has low wear. Furthermore, in particular, a method for operating a sanitary fitting is to be specified that is economical to produce, allows a use of standard components, and has low wear.

These objects are attained with an exemplary method for operating a sanitary fitting and a sanitary fitting with the features of the independent claims. Additional advantageous embodiments of the invention are specified in the dependent claims. It should be noted that the individual features specified in the claims can be combined with one another in any technologically useful manner desired, and thus define additional embodiments of the invention. Moreover, the features specified in the claims are stated more precisely and explained in detail in the description, with additional preferred embodiments of the invention being described.

In an embodiment, the invention specifies a method for operating a sanitary fitting. This sanitary fitting is equipped to deliver a water jet. The sanitary fitting has at least one manual actuator and a sensor arrangement. The at least one manual actuator is equipped for manual regulation of at least one water jet flow rate or a water jet temperature. The sensor arrangement is equipped for sensor-controlled regulation of a predefined water jet flow rate and a predefined water jet temperature. The method comprises:

a) monitoring by the sensor arrangement of an external detection area, b) detection by the sensor arrangement of the presence of an object in the detection area, c) evaluation of the first detected object and distinguishing whether the first detected object is a water jet or a different object, and d) sensor-controlled regulation of the predefined water jet flow rate and the predefined water jet temperature if the different object was detected first in the detection area, wherein the sensor-controlled regulation is inhibited if a water jet was detected first in the detection area.

The present invention is based on the idea of using the sensor that is already present in a hybrid fitting to obtain information as to whether a manual regulation of the hybrid fitting was performed by means of an adjusting lever or whether a sensor-controlled regulation of a predefined water jet should take place. The invention makes it possible in an advantageous manner to dispense with additional mechanical measuring elements that would otherwise be required for detecting the actuating position of the adjusting lever. Consequently, more economical manufacture is made possible of a hybrid fitting that can be constructed with standard components and also has lower wear because of reduced additional mechanical measuring elements.

The sanitary fitting considered here can also be called a hybrid fitting. The sanitary fitting includes, in particular, a thermostatic mixing fitting that can be used as a washbasin fitting, shower fitting, or bathtub fitting, wherein the thermostatic mixing fitting is combined here with a sensor-controlled fitting. As a rule, the sanitary fitting has at least one outlet, wherein a water jet can be delivered through the outlet.

The sanitary fitting has at least one manual actuator. The actuator can be constructed in the manner of an adjusting lever or mixing lever. This is not mandatory, however, because the actuator can also be constructed by means of a rotary valve closure, a rotary knob, or the like. If the actuator is constructed in the manner of a (single) adjusting lever, then a water jet volume or a water jet flow rate can be predefined as a function of a first adjustment angle of the adjusting lever. In this context, a water jet temperature can be regulated as a function of a second adjustment angle of the adjusting lever. The first adjustment angle can be set or changed by means of a tilting motion and the second adjustment angle by means of a rotary motion. A regulation by means of the actuator is referred to here as manual regulation.

In addition, the sanitary fitting has a sensor arrangement. The sensor arrangement is located, in particular, in an area of the sanitary fitting below the actuator. As a result, it is possible for an object located below an outlet of the sanitary fitting to be detected by the sensor arrangement. Alternatively or in addition, it is possible to locate the sensor arrangement in an area next to the actuator and/or above the actuator. Preferably the sensor arrangement has, at a minimum, at least one optical sensor, at least one acoustic sensor, in particular an ultrasonic sensor, or the like. An (optical) sensor converts (optical) information, in particular light, into signals that can be used electronically. An optical sensor here is, in particular, an infrared sensor, a camera, an image sensor, a photoelectric sensor, or the like. The optical sensor can detect, in particular, visible light and/or infrared radiation and/or ultraviolet light. Preferably the (optical) sensor has a (light) transmitter and a (light) receiver. Preferably the optical sensor is a linear sensor, especially preferably with a resolution of 128×1 pixels. The optical sensor can be constructed in the manner of a matrix of individual diodes, wherein the matrix preferably has a resolution of 300×300 pixels, further preferably 300×200 pixels, and especially preferably 128×128 pixels. It is additionally preferred for the sensor arrangement to have at least one control unit. Such a control unit can be implemented in the form of a microcontroller or the like.

A sensor-controlled regulation can be understood here to mean, in particular, a regulation by means of the sensor arrangement through at least one sensor signal. On the basis of the sensor-controlled regulation, the sanitary fitting delivers a water jet with a predefined volume of water or predefined water jet flow rate and with a predetermined water jet temperature. Touchless operation of the sanitary fitting can be accomplished by means of the sensor arrangement.

The sanitary fitting can have one water circuit or multiple water circuits. Preferably the sanitary fitting has a manual water circuit and a sensor-controlled water circuit. The water circuits can be used independently of one another here. At least the sensor-controlled water circuit can be opened and closed by means of a solenoid valve. To this end, the solenoid valve can receive a signal from the sensor arrangement. The water circuits can be opened and closed dependently or independently of one another by means of at least one solenoid valve, at least one electric valve, and/or at least one mechanical valve.

The sensor arrangement monitors an external detection area. The external detection area relates here, in particular, to an area below an outlet of the sanitary fitting. The external detection area is an area that is outside a housing of the sanitary fitting and located in a measurement range of the sensor arrangement. The measurement range of the sensor arrangement can extend over an area next to the outlet and/or above the outlet. The detection area has a detection area length and a detection area width. In particular, the detection area also has a detection area depth. A length can be understood as an extent in the longitudinal direction, and a width can be understood as an extent at right angles to the longitudinal direction. The depth can be understood as an extent at right angles to the length and at right angles to the width. The external detection area can thus also be implemented as a (three-dimensional) space in front of and/or around the sanitary fitting, which is located in the measurement range of the sensor arrangement. The longitudinal direction is referenced to a vertical axis here. The longitudinal direction is identifiable in the figures.

The sensor arrangement is equipped to detect the presence of an object in the detection area. If the sensor arrangement includes at least one transmitter and at least one receiver, then the presence of an object can be detected by the means that a signal emitted by the transmitter, in particular light or sound, is reflected by the object and detected by the receiver. By means of a transit time measurement or the like, therefore, an object distance between the sensor arrangement and the object can be measured.

In addition to and/or instead of a distance measurement, the sensor arrangement can also be equipped to measure or to detect an object width. For this purpose, a linear sensor can be oriented horizontally, or multiple sensors of the sensor arrangement can be arranged horizontally next to one another. In this case, border areas next to a water jet can also be detected.

The sensor arrangement can be equipped to evaluate a first detected object and to distinguish whether the first detected object is a water jet or a different object. The reference to the "first detected" object is meant to express that a decision on the nature of the object should take place in a time interval (chosen to be short) after triggering—which is to say that if the water jet is in fact mechanically started first, and hands are then washed in the water jet, only the "first detected" object (here, the water jet) should be controlling.

The sensor arrangement can have a control unit. It is not mandatory, however, for the control unit to be integrated into the sensor arrangement. Instead, the control unit can also be provided at a different location in the sanitary fitting, and be equipped to evaluate the first detected object and to distinguish whether the first detected object is a water jet or a different object. During evaluation of the detected object, the question of which object was detected first is especially important here.

A "different object" can be understood here to be a thing that is not a water jet and, in particular, does not have the external geometry of a water jet. The "different object" can be, for example, a toothbrush, a cup, a hand, an arm, a person's head, or the like.

A water jet in the detection area is detected in particular when an object distance determined by means of the sensor arrangement or an object width determined by means of the sensor arrangement is located in a predefined water jet region. A different object in the detection area is detected in particular when an object distance determined by means of the sensor arrangement or an object width determined by means of the sensor arrangement is located outside a predefined water jet region. The predefined water jet region is defined here as between a minimum water jet distance and a maximum water jet distance and/or between a minimum water jet width and a maximum water jet width. The water jet flows out of the sanitary fitting in a flow direction. The water jet distance can vary when viewed in the longitudinal direction depending on the orientation of the flow direction in relationship to the orientation of the sensor arrangement. The sensor arrangement is preferably equipped to allow for an orientation differing from the flow direction.

If the different object was detected first in the detection area, then a sensor-controlled regulation of the predefined water jet flow rate and the predefined water jet temperature takes place (first or exclusively). In particular, a sensor-controlled water circuit is opened in this case. If a water jet was detected first in the detection area, then sensor-controlled regulation is inhibited. In particular, a sensor-controlled water circuit remains closed in this case. As long as sensor-controlled regulation is inhibited, no sensor-controlled regulation of the predefined water jet flow rate and the predefined water jet temperature takes place. As a rule, then, a water jet is detected first when the sanitary fitting is manually operated by means of the actuator. In this situation, a sensor-controlled regulation of the predefined water jet temperature and the predefined water jet flow rate is undesirable.

According to an embodiment, it is proposed that the predefined water jet volume and the predefined water jet temperature are stopped when the different object is no longer detected in the detection area and it was previously determined in step c) that the different object was detected first. It is advantageously achieved by this means that a sensor-controlled regulation is terminated again when the different object is no longer located in the detection area. Consequently, the most water-conserving operation possible of the sanitary fitting can be achieved, in particular. It is also possible, however, that the sensor-controlled regulation, and thus the delivery of the predefined water jet flow rate and of the predefined water jet temperature, are terminated after the expiration of a period of time to be specified. An appropriate period of time may be, e.g., 30 seconds or preferably 20 seconds.

According to an embodiment, it is proposed that the different object is at least a hand or an object that has a larger extent viewed in the transverse direction than the water jet. The extent of the water jet in the transverse direction relates here to the diameter of the water jet. The transverse direction relates here to a direction oriented at right angles to the longitudinal direction. The description rendered here of the different object is advantageous in the circumstance when the sensor arrangement is equipped to measure an object width.

According to an embodiment, it is proposed that the evaluation in step c) is accomplished by means of a control unit. The control unit can be integrated in the sensor arrangement in this case. In particular, the control unit is integrated in the sanitary fitting in such a manner that it can bring about and/or monitor the method discussed.

The described mode of operation of the sanitary fitting is achieved, in particular, by the means that the sensor arrangement carries out an object scanning and an object assessment in the external detection area. The described mode of operation is possible because of reasons including independent fitting circuits of the sanitary fitting, in particular. The object scanning and object assessment described here take place in such a manner that if a different object, in particular a hand, is detected first in the detection area, the sensor-controlled water circuit is opened, in particular by means of a solenoid valve. But if a water jet, triggered through the manual actuator, is detected first and a hand is only detected afterward, then the sensor-controlled water circuit remains closed. In this case the water jet is adjusted solely through the manual actuator.

The described mode of operation of the sanitary fitting advantageously also offers high operational reliability. It is now possible for even a minimal emerging water jet to be detected that known mechanical measuring elements would not yet be able to detect. This is made possible because of the optical detection of the invention.

The invention also relates to a sanitary fitting that is equipped to deliver a water jet. The sanitary fitting has at least one manual actuator for manual regulation of at least a water jet flow rate or a water jet temperature, and a sensor arrangement that is equipped for sensor-controlled regulation of a predefined water jet flow rate and a predefined water jet temperature. The sensor arrangement is equipped to detect the presence of an object in an external detection area. In addition, a control unit is provided that is equipped to evaluate a first detected object and to distinguish whether the first detected object is a water jet or a different object.

According to an embodiment, it is proposed that the control unit is integrated in the sensor arrangement.

According to an embodiment, it is proposed that the control unit is equipped to carry out the above described method.

According to an embodiment, it is proposed that the sensor arrangement includes at least one optical or acoustic sensor that is arranged in alignment with the water jet, and wherein the detection area has a detection area width that is greater than a diameter of a water jet. Such an arrangement is especially advantageous when the sensor arrangement is equipped to measure or to detect an object width. Such an arrangement makes it possible to detect border areas next to the water jet as well.

According to an embodiment, it is proposed that at least a detection area length is greater than a sensor arrangement length or a detection area width is greater than a sensor arrangement width. It is advantageously made possible by this means that even such objects as are not located directly in front of the sensor arrangement will be detected. Consequently, it is even possible for, e.g., a hand to be detected that is located in a washbasin and is not on a level with the sensor arrangement when viewed in the longitudinal direction. Such a detection or recognition can be made possible by the means that in the case of an optical sensor, for example, light is emitted or received in different directions or over a horizontal and/or a vertical angle range.

According to an embodiment, it is proposed that no mechanical sensor is provided for detecting a stroke of the actuator. Even though it is indeed possible to retrofit the present invention in a known hybrid fitting, it is nevertheless preferred to dispense with an additional mechanical measuring element or a mechanical sensor and the associated analysis of the state of the actuator to configure operation. If a mechanical sensor is dispensed with, substantially lower wear of the sanitary fitting can be achieved.

The details, features, and advantageous embodiments discussed above in connection with the method can also occur correspondingly in the sanitary fitting introduced here. In this respect, reference is made in full to the discussion above concerning detailed characterization of the method.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
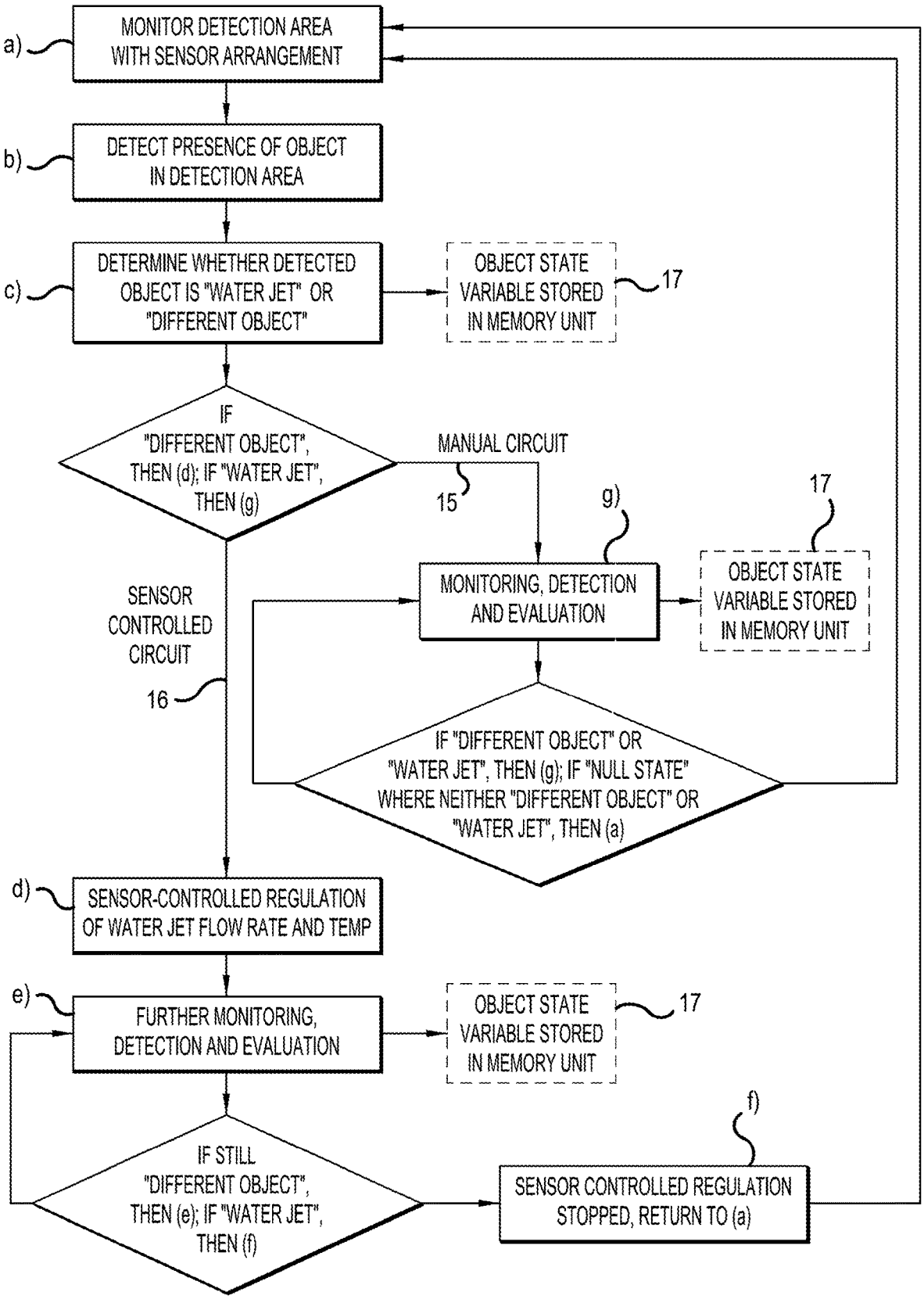
FIG. 1 is a basic illustration of the method for operating a sanitary fitting.

FIG. 1 shows a schematic and basic illustration of the method for operating a sanitary fitting. The method starts here in step a) with the monitoring by the sensor arrangement of an external detection area. If an object is present in the detection area, then detection by the sensor arrangement of the presence of an object in the detection area follows in step b). This is followed in step c) by an evaluation of the object detected first and a distinguishing of whether the first detected object is a water jet or a different object. The method can be carried out by means of a microcontroller by way of example. The microcontroller here also has a memory unit. State variables can be stored in the memory unit. In step c) an object state variable 17 is stored here. The object state variable 17 can assume three values or three states. The first state is referred to here as "water jet" and is stored when it has been determined in step c) that the first detected object is a water jet. The second state of the object state variable 17 is referred to here as "different object" and is stored when it has been determined in step c) that the first detected object is a different object. If neither the first state nor the second state is recognized or is no longer recognized, then "null" is stored here as the third state by way of example.

The step c) is followed here by an if-then decision. If the stored object state variable 17 is the "different object" state, then in step d) a sensor-controlled regulation of the predefined water jet flow rate and the predefined water jet temperature follows. In this case, the method is continued in a sensor-controlled circuit 16. If the state stored in step c) is "water jet," however, then the method is continued in a manual circuit 15. By way of example, in the sensor-controlled circuit 16, the step d) is followed by a step e), in which a further monitoring, detection, and evaluation is carried out. Here, the object state variable 17 is again stored. The step e) is followed once again by an if-then decision. If the state now stored is still "different object," then the sensor-controlled regulation of the predefined water jet flow rate and the predefined water jet temperature continues to occur. But if the "water jet" state was stored, then the sensor-controlled regulation is stopped in a step f). After the stoppage, the method starts again with step a).

It can also be seen in FIG. 1 that the method in the manual circuit 15 is pursued further if the object state variable 17 has the "water jet" state in the first if-then decision. In this case a monitoring, detection, and evaluation follows here by way of example in a step g), wherein the object state variable 17 is stored here as well. An if-then decision follows here as well, wherein step g) continues to be executed if the object state variable 17 has the "different object" or "water jet" state. If the object state variable 17 has the "null" state, however, then the method begins again with step a).

Figure 2:
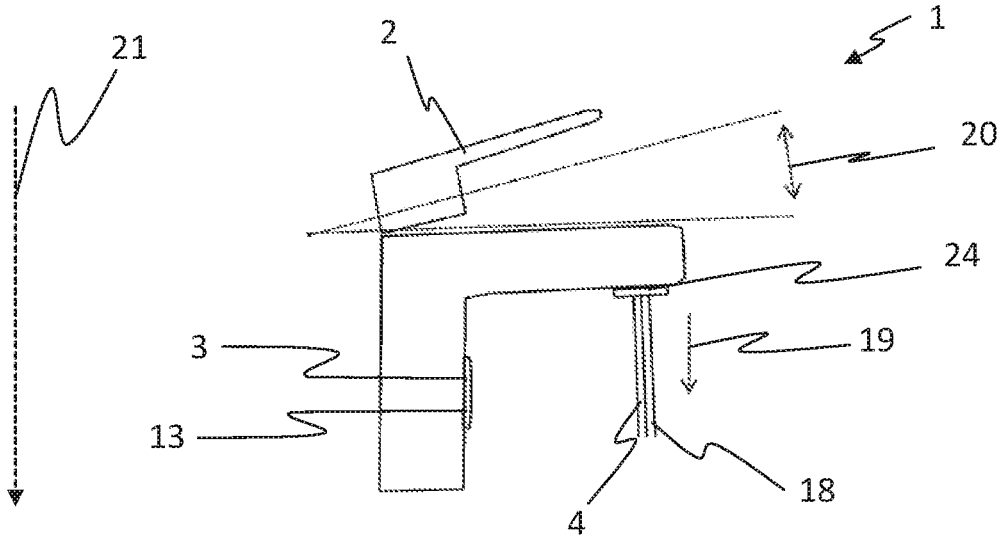
FIG. 2 is a first manual regulation of a water flow rate.

In FIG. 2, a first manual regulation of a water jet flow rate 18 of a sanitary fitting 1 is shown. The sanitary fitting 1 has an actuator 2 and a sensor arrangement 3. The sensor arrangement 3 is implemented with an optical sensor 13 by way of example. The sanitary fitting 1 has an outlet 24, from which the water jet 4 emerges. The actuator 2 is constructed in the manner of an adjusting lever here. The actuator 2 is displaced upward in the manner of a tilting motion and is in a minimum opening position. In this minimum opening position, a minimum first adjustment angle 20 can be seen. Consequently, the sanitary fitting 1 delivers a minimum water jet 4 with a minimum water jet flow rate 18. The water jet 4 has a flow direction 19 here. Even this minimum water jet flow rate 18 or the minimum water jet 4 is detected by means of the sensor arrangement 3.

Additionally indicated in FIG. 2 is a longitudinal direction 21; a transverse direction points into the plane of the drawing here. Viewed in the transverse direction, the sensor arrangement 3 is arranged in alignment with the water jet 4 so that it can detect the water jet 4.

Figure 3:
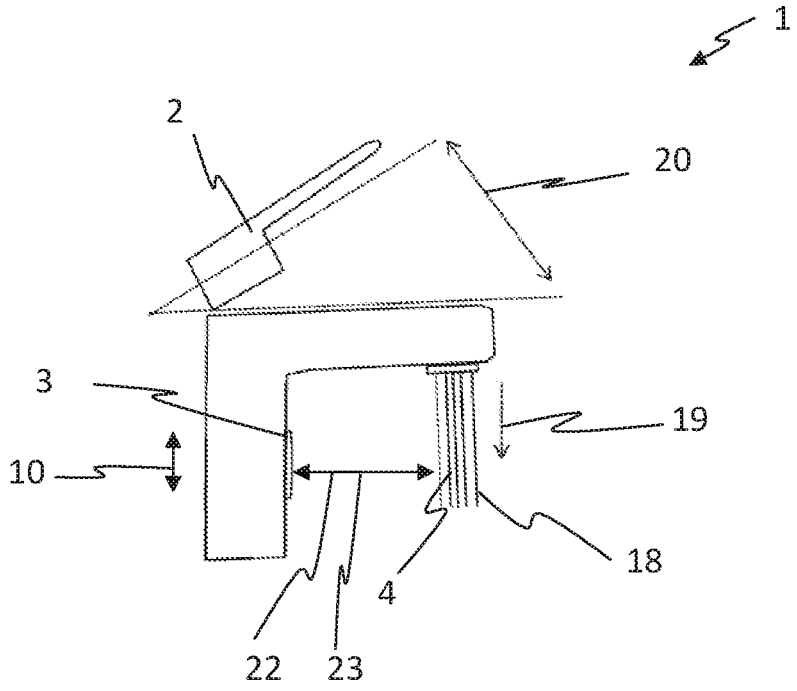
FIG. 3 is a second manual regulation of a water flow rate.

In FIG. 3, a second manual regulation of a water jet flow rate 18 of a sanitary fitting 1 is shown. The sanitary fitting 1 has an actuator 2 and a sensor arrangement 3. The sensor arrangement 3 has a sensor arrangement length 10. The sanitary fitting 1 delivers a maximum water jet 4 with a maximum water jet flow rate 18. For this purpose, the actuator 2 is located in a maximum opening position. The maximum opening position is represented by means of the maximum first adjustment angle 20.

It is evident from the representation in FIG. 3 that the sensor arrangement 3 is equipped such that it measures or detects or determines an object distance 22. The object distance 22 here is located in a predetermined water jet region, which is associated with the presence of a water jet 4. If the sensor arrangement 3 measures an object distance 22 in this predefined water jet region, then the presence of a water jet 4 is detected. In FIG. 3, the object distance 22 is equal to a water jet distance 23.

Figure 4:
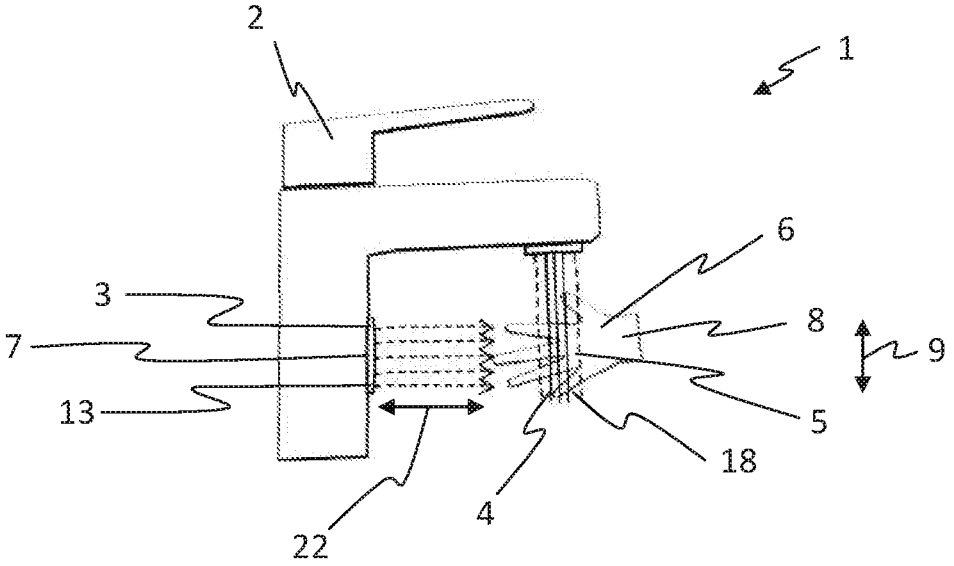
FIG. 4 is a sensor-controlled regulation of a predefined water flow rate.

In FIG. 4, a sensor-controlled regulation of a predefined water jet flow rate 18 of a sanitary fitting 1 is shown. It can be seen that the actuator 2 is in a closed position. A different object 6, namely a hand 8, is located in a detection area 5 of the sensor arrangement 3. The sensor arrangement 3 is constructed here with an optical sensor 13. By way of example, a control unit 7 is integrated in the sensor arrangement 3. Here, the different object 6 or the hand 8 was detected first by the sensor arrangement 3. The different object 6 was recognized by the means that a measured object distance 22 is less than a minimum water jet distance 23 of a predefined water jet region. Consequently, the measured object distance 22 lies outside the predefined water jet region. Because a different object 6 was detected first here, a sensor-controlled regulation of the predefined water jet flow rate 18 takes place. In this connection, the water jet 4 also has a predefined water jet temperature, which is not indicated here. The optical sensor 13 of the sensor arrangement 3 is aligned with the water jet 4 here when viewed in the longitudinal direction 21 or vertically and in the transverse direction. The sensor arrangement 3 thus monitors a detection area length 9 of the detection area 5.

Figure 5:
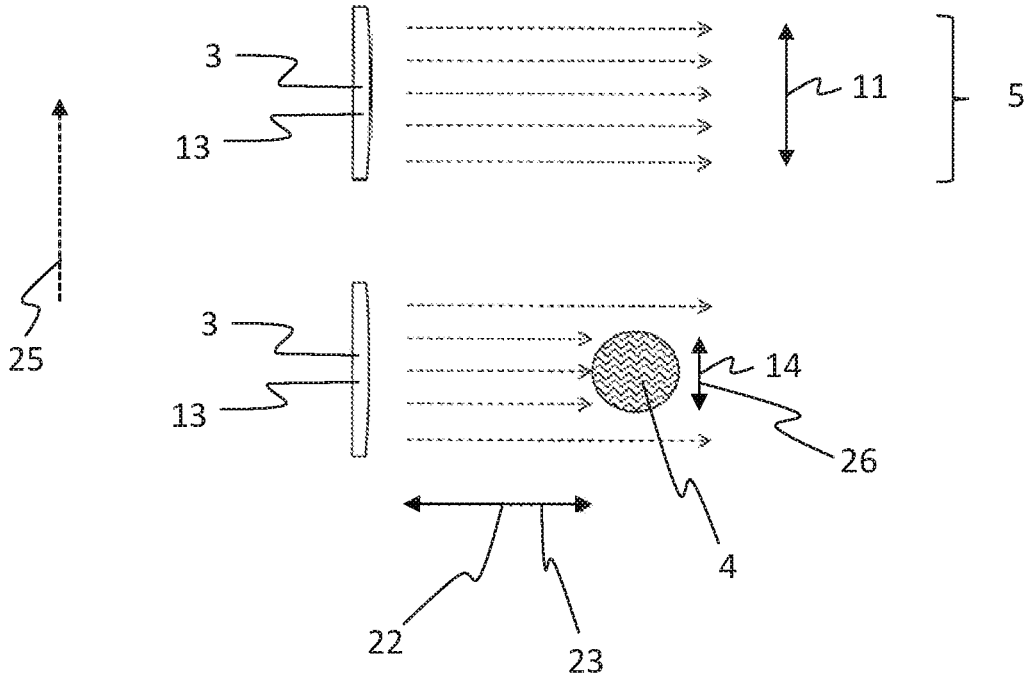
FIG. 5 is a detection of the presence of an object.

In FIG. 5, a sensor arrangement 3 is shown that is constructed with an optical sensor 13. The view here is from above onto a sensor arrangement 3. For the purpose of orientation, a transverse direction 25 is indicated in FIG. 5, with a longitudinal direction here projecting into the plane of the drawing. Accordingly, the sensor arrangement 3 is oriented in the transverse direction 25 or horizontally. The sensor arrangement 3 or the optical sensor 13 thus detects a detection area width 11 of a detection area 5. In the top part of FIG. 5, no object is present, for which reason no object is detected here by the sensor arrangement 3. In the bottom part of FIG. 5, a water jet 4 can be seen in cross-section with a water jet diameter 14 in the detection area 5. By means of the horizontally oriented sensor arrangement 3, border areas next to the water jet 4 can also be detected.

The sensor arrangement 3 detects the presence of an object here, namely the presence of the water jet 4. The fact that it is a water jet 4 is detected because a measured object distance 22 is located in a predefined water jet region. Consequently, the measured object distance 22 corresponds here to a water jet distance 23.

By means of the horizontally oriented sensor arrangement 3 from FIG. 5, an object width 26 can also be measured. For this purpose, the sensor arrangement 3 is constructed by way of example with multiple optical sensors 13 arranged next to one another in the transverse direction. Here, too, a water jet 4 is detected because the measured object width 26 is located in a predefined water jet region. The measured object width 26 corresponds here to the water jet diameter 14.

A method for operating a sanitary fitting and a sanitary fitting are thus disclosed, wherein economical production, the use of standard components, and low wear are made possible. Moreover, high operational reliability is ensured, since even a minimal water jet can be detected by means of the sensor arrangement.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for operating a sanitary fitting that is adapted to deliver a water jet, having at least one manual actuator for a manual regulation of at least one of water jet flow rate or a water jet temperature, and a sensor arrangement that is equipped for sensor-controlled regulation of a predefined water jet flow rate and a predefined water jet temperature, the method comprising:

monitoring an external detection area by the sensor arrangement;

detecting a presence of an object in the detection area by the sensor arrangement, the object being a first detected object;

evaluating the first detected object and distinguishing whether the first detected object is a water jet or a different object; and sensor-controlled regulating of the predefined water jet flow rate and the predefined water jet temperature if the first detected object is the different object, the sensor-controlled regulating being inhibited if the first detected object is the water jet.

2. The method according to claim 1, wherein the first detected object is the different object and wherein the predefined water jet flow rate and the predefined water jet temperature are stopped when the different object is no longer detected in the detection area.

3. The method according to claim 1, wherein the different object is at least a hand or another object that has a larger extent viewed in a transverse direction than the water jet.

4. The method according to claim 1, wherein the step of evaluating the first detected object is performed by a control unit.

5. A sanitary fitting adapted to deliver a water jet, the sanitary fitting comprising:

at least one manual actuator for a manual regulation of at least one of a water jet flow rate or a water jet temperature;

a sensor arrangement for sensor-controlled regulation of a predefined water jet flow rate and a predefined water jet temperature, the sensor arrangement being adapted to detect a presence of an object in an external detection area, the object being a first detected object; and a control unit adapted to evaluate the first detected object and to distinguish whether the first detected object is a water jet or a different object, wherein the control unit is configured to:

evaluate the first detected object and distinguish whether the first detected object is the water jet or the different object; and perform sensor-controlled regulation of the predefined water jet flow rate and the predefined water jet temperature if the first detected object is the different object, the sensor-controlled regulating being inhibited if the first detected object is the water jet.

6. The sanitary fitting according to claim 5, wherein the control unit is integrated in the sensor arrangement.

7. The sanitary fitting according to claim 5, wherein the sensor arrangement includes at least one optical sensor that is arranged in alignment with the water jet, and wherein the detection area has a detection area width that is greater than a water jet diameter.

8. The sanitary fitting according to claim 5, wherein at least a detection area length of the detection area is greater than a sensor arrangement length of the sensor arrangement or wherein a detection area width of the detection area is greater than a sensor arrangement width of the sensor arrangement.

9. The sanitary fitting according to claim 5, wherein no mechanical sensor is provided for detecting a stroke of the actuator.

* * * * *